US008584487B2

(12) United States Patent
Lifson et al.

(10) Patent No.: US 8,584,487 B2
(45) Date of Patent: Nov. 19, 2013

(54) REFRIGERANT SYSTEM WITH EXPANDER SPEED CONTROL

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 957 days.

(21) Appl. No.: 12/528,486

(22) PCT Filed: Apr. 10, 2007

(86) PCT No.: PCT/US2007/066278

§ 371 (c)(1), (2), (4) Date: Aug. 25, 2009

(87) PCT Pub. No.: WO2008/123884

PCT Pub. Date: Oct. 16, 2008

(65) Prior Publication Data

US 2010/0083678 A1 Apr. 8, 2010

(51) Int. Cl.
*F25B 1/00* (2006.01)

(52) U.S. Cl.
USPC ..... 62/510; 62/87

(58) Field of Classification Search
USPC ..... 62/116, 117, 500, 510, 640, 87, 62/401–402
See application file for complete search history.

(56) References Cited

U.S. PATENT DOCUMENTS

| | | | | |
|---|---|---|---|---|
| 3,266,261 | A * | 8/1966 | Anderson | 62/50.3 |
| 3,321,930 | A * | 5/1967 | La Fleur | 62/228.4 |
| 3,362,626 | A * | 1/1968 | Schlirf | 417/26 |
| 3,788,066 | A | 1/1974 | Nebgen | |
| 4,281,970 | A * | 8/1981 | Stewart et al. | 417/53 |
| 6,131,402 | A | 10/2000 | Mills, Jr. et al. | |
| 6,185,956 | B1 * | 2/2001 | Brasz | 62/498 |
| 6,199,387 | B1 * | 3/2001 | Sauterleute | 62/87 |
| 6,898,941 | B2 | 5/2005 | Sienel | |
| 2004/0250556 | A1 * | 12/2004 | Sienel | 62/88 |

OTHER PUBLICATIONS

Search Report and Written Opinion mailed on Dec. 26, 2007 for PCT/US2007/66278.

Notification of Transmittal of International Preliminary Report on Patentability mail on Aug. 4, 2009 for PCT/US2007/66278.

* cited by examiner

*Primary Examiner* — Melvin Jones
(74) *Attorney, Agent, or Firm* — Carlson, Gaskey & Olds

(57) ABSTRACT

A refrigerant system utilizes an expander to expand refrigerant and to drive or assist in driving an associated compressor. By varying the compressor load, the speed of the expander can be adjusted to achieve the desired thermodynamic characteristics of the expanding refrigerant and enhance expander operation.

2 Claims, 2 Drawing Sheets

REFRIGERANT SYSTEM WITH EXPANDER SPEED CONTROL

BACKGROUND OF THE INVENTION

Refrigerant systems are known to utilize refrigerant circulating throughout a closed-loop circuit to condition a secondary fluid. Typically, a refrigerant system includes a compressor for compressing the refrigerant, and delivering the refrigerant to a downstream heat exchanger. Refrigerant from that downstream heat exchanger passes through an expansion device, and then to an evaporator. In traditional refrigerant systems, the expansion device is a fixed area restriction or a valve that may be controlled such that the amount of expansion is tailored to achieve desired characteristics in operation of the refrigerant system.

In some advanced refrigerant systems, the work which is available from the expansion process of the refrigerant is utilized to drive or assist in driving at least one component within the refrigerant system.

In one known refrigerant system configuration, a secondary compressor operates in parallel with a main compressor. This secondary compressor compresses a portion of the refrigerant circulated throughout the refrigerant system. The secondary compressor is driven by the expander, with the expander operating much like a turbine, to receive the compressed refrigerant, and expand that refrigerant to a lower pressure and temperature. The work from this expansion process is utilized to drive the secondary compressor. This known combination of a compressor and an expander, located on the same shaft, is called an expresser. The use of the expresser is known in the industry, where the expander drives or assists in driving the corresponding compressor. The refrigerant exiting a heat rejection heat exchanger enters the expander, and then is expanded to a lower pressure and temperature. A two-phase flow exiting the expander enters the evaporator. The work extracted from the expansion process in the expander is used to drive the secondary compressor that is quite often located on the same shaft as the expander. In addition to extracting useful work from the expansion process, the refrigerant passing through the expander acquires a higher cooling thermodynamic potential, as it expands through the expander, since it follows a more efficient isentropic process. The use of the expresser technology is especially expected to grow in $CO_2$ applications, where the potential for the expansion energy recovery is higher than for the conventional refrigerants.

One of the disadvantages of positioning the expander and the associated compressor into a closely coupled mechanical engagement, such as locating them on the same shaft, is that the expander speed is not actively controlled. In other words, the expander will settle at a speed at which the power extracted by the expander from the refrigerant expansion process is roughly equal to and is balanced by the power delivered to the compressor. Since the expander speed cannot be actively controlled, the expansion process through the expander is typically not optimal. If the expansion process is not optimal, then the amount of refrigerant delivered to the evaporator, and its thermodynamic state, cannot be precisely controlled. If a delivered amount of refrigerant cannot be adjusted, it may result, for instance, in less than optimal gas cooler pressure, in transcritical applications, and/or undesirable conditions at the compressor entrance.

In other words, to optimize the expansion process for given operating and environmental conditions, such as gas cooler pressure, suction superheat, etc., flexibility in varying the expander speed must be provided. One way to enhance the control of the expander is to install an expansion valve that is located in series with the expander. However, the expansion valve would reduce/limit the amount of the work extracted from the expansion process by the expander. This reduction would occur, as part of the expansion process would take place in the expansion valve, and not in the expander. Therefore, a need exists to optimize the expresser operation.

SUMMARY OF THE INVENTION

In this invention, the expansion process in the expander is controlled by adjusting the speed of the expander. The higher the expander speed, the more refrigerant can be passed through the expander. Similarly, the lower the expander speed, the less refrigerant passes through the expander. The expander speed of the expresser (a mechanically coupled compressor-expender configuration) is adjusted by changing the load on the compressor component of the expresser. Compressor unloading can be accomplished by using various unloading techniques such as, for example, moving a slide valve of a screw compressor, opening a bypass port of the scroll compressor, using suction cutoff of a reciprocating compressor, installing a suction modulation valve, or utilizing any other known techniques to reduce the compressor load. This compressor load reduction causes the expander speed to increase.

Similarly, loading the associated compressor component of the expresser results in a speed decrease of the expander component of the expresser. Therefore, by utilizing the proper amount of compressor unloading we can very the expresser speed and thus optimize the expansion process. This is true since the expander speed varies along with the expresser speed, as both the compressor and expander are closely mechanically coupled, such as located on the same shaft. An ability to change the expander speed is similar to adjusting the amount of flow by using a variable restriction expansion device, such as an electronic expansion valve, in comparison to inefficient fixed cross-sectional area expansion device, such as a capillary tube or orifice.

These and other features of the present invention can be best understood from the following specification and drawings, the following of which is a brief description.

DETAILED DESCRIPTION OF THE PREFERRED EMBODIMENTS

Figure 1:
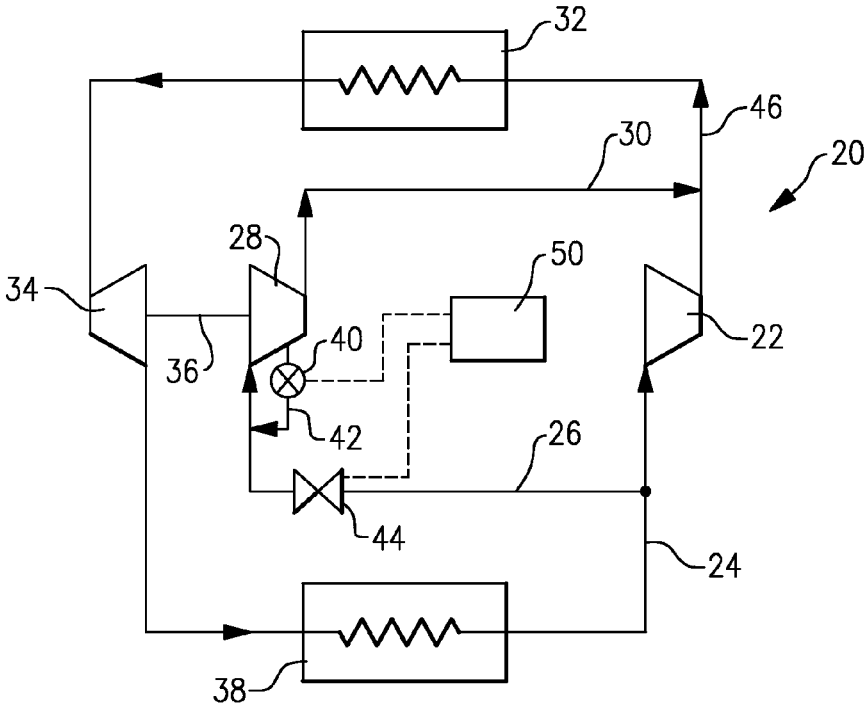
FIG. 1 is a schematic view of a refrigerant system incorporating the present invention.

A refrigerant system 20 is illustrated in FIG. 1. A main compressor 22 compresses a refrigerant received from a main suction line 24. As shown, a secondary suction line 26 delivers a portion of the refrigerant flow through a secondary compressor 28. Refrigerant compressed by the secondary compressor 28 is delivered through a secondary discharge line 30 to a main discharge line 46, positioned on a high side of the refrigerant system 20, to be combined with the refrigerant delivered from the main compressor 22. The combined refrigerant flow passes through a heat rejection heat exchanger 32, where the heat is removed from the refrigerant by a secondary fluid typically delivered to an ambient environment. The heat rejection heat exchanger 32 is called a condenser, if the refrigerant passes through the thermodynamic states within the heat exchanger 32 that are below the critical point, or a gas cooler, if the refrigerant passes through the thermodynamic states within the heat exchanger 32 that are above the critical point.

Downstream of the condenser 32, an expansion process, to a lower pressure and temperature, occurs in an expander 34. As known, the expander 34 takes the compressed refrigerant from the heat rejection heat exchanger (a subcritical condenser or a supercritical gas cooler) 32, and utilizes energy from that compressed refrigerant to drive the expander, while the compressed refrigerant is "isentropically" expanded to a lower pressure and temperature. A shaft 36 (alternatively a generator) is driven by the expander 34, and this shaft (or power from the generator) in turn drives the secondary compressor 28. Such systems are known as "expressers."

A heat exchanger, or an evaporator, 38 is positioned downstream of the expander 34. The evaporator 38 is located on a lower pressure side of the refrigerant system 20, and heat is transferred to the refrigerant in the evaporator 38 from a secondary fluid to be delivered to a climate-controlled space. Refrigerant passes from the expander 34, through the evaporator 38, and back into the suction line 24 to return to the compressors 22 and 28. The refrigerant system 20, as described to this point, is as known in the art. Obviously, the basic refrigerant system 20 may have additional features or enhancement options. All these variations in refrigerant system configurations are within the scope and can equally benefit from the invention.

A control 50 for the refrigerant system 20 operates components such as a bypass valve 40, and/or a suction modulation valve 44, both associated with the secondary compressor 28, to limit the amount of refrigerant compressed by the secondary compressor 28, and thus to unload the compressor 28. By reducing the amount of refrigerant compressed by the secondary compressor 28, the speed of the expander 34 mechanically coupled with the compressor 28 can be increased. The expander speed adjustment achieves desired thermodynamic characteristics of the expanding refrigerant that can be optimized for specific operating conditions. The desired thermodynamic characteristics of the expanding refrigerant tailored to a specific set of operating conditions are as known in the art, and have been utilized for operation and control of electronic expansion valves. However, achieving desired thermodynamic characteristics of the expanding refrigerant have been limited with systems utilizing expanders, since the expander speed is not usually actively controlled.

However, by utilizing the control 50, and selectively operating, for example, either the bypass valve 40 to control the amount of refrigerant bypassed through a bypass line 42, or by limiting the amount of refrigerant passing through a suction modulation valve 44 and reaching the secondary compressor 28, the amount of refrigerant compressed by the secondary compressor 28, and thus the speed of the expander 34, can be controlled. The control 50 may also be operated in a pulse width modulation mode to rapidly cycle either valve 40 or 44 between open and closed positions to achieve precise control over the amount of refrigerant compressed by the secondary compressor 28. Obviously, the valves 40 and 44 may operate in conjunction with each other to achieve the desired level of unloading of the secondary compressor 28.

Compressor unloading can be accomplished by using various unloading techniques such as, for example, moving a slide valve of a screw compressor, opening a bypass port of the scroll compressor, using suction cutoff of a reciprocating compressor, installing a suction modulation valve, or utilizing any other known techniques to reduce the compressor load.

Figure 2:
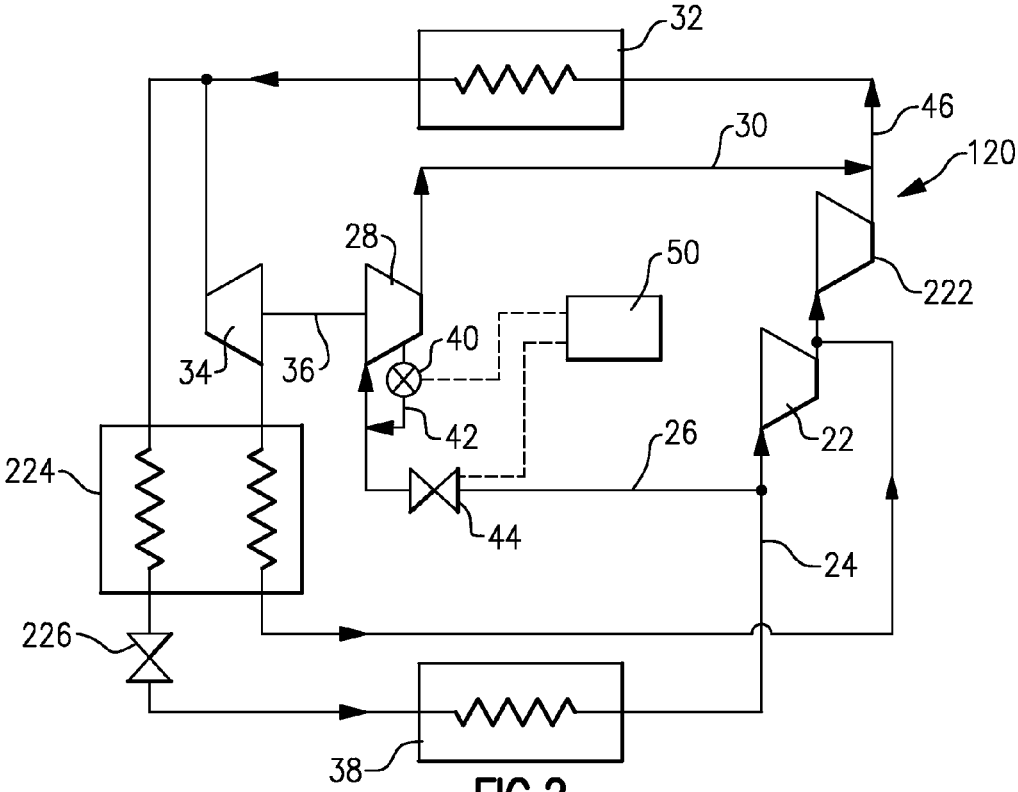
FIG. 2 is a view of another schematic.

To be operational and to take advantage of the invention, the expander 34 does not have to be connected to the high source of pressure associated with the heat rejection heat exchanger 32 and to the source of low pressure associated with the evaporator 38. To perform the expansion function, the expander can be connected to an intermediate pressure point in the refrigerant system 120 as shown in FIG. 2. In refrigerant system 120, the main compressor may consist of two compressor stages 22 and 222 connected in series. In the embodiment shown in FIG. 2, the expander 34 is incorporated into a loop associated with a vapor injection or economizer cycle, where the expander 34 is expanding the refrigerant from the pressure associated with the heat rejection heat exchanger 32 to the intermediate cycle pressure approximated by the pressure between the first compression stage 22 and the second compression stage 222. Economizer cycles are known in the art, and the benefits provided by economizer cycles are associated with additional subcooling obtained in the economizer heat exchanger 224 and a more efficient compression process, due to refrigerant vapor injection between sequential compression stages 22 and 222. The refrigerant undergoing expansion in the expander 34, from a high-side to intermediate pressure, provides even greater subcooling to the main flow in the economizer heat exchanger 224, where the main flow undergoes expansion in a main expansion device 226. This greater subcooling, and higher cooling thermodynamic potential for refrigerant entering the evaporator 38, is achieved due to more efficient isentropic expansion process, in comparison to isenthalpic expansion process provided by traditional expansion devices. The expansion device 226 can be, for example, a fixed area orifice, a capillary tube, a thermostatic expansion valve, an electronic expansion valve, another expander or a combination of different expansion devices. As in the embodiment shown in FIG. 1, the expander 34 of the FIG. 2 embodiment is associated with secondary compressor 28 and takes advantages of the selective unloading of this compressor, as discussed above. In this case, the secondary compressor 28 operates in a parallel arrangement (or in tandem) with the primary compressor 22, which in combination with the compressor 28, provide the first stage of compression, from a suction pressure to an intermediate pressure. Of course, as known in the art, the two compression stages 22 and 222 may be provided within a single compressor housing.

Figure 3:
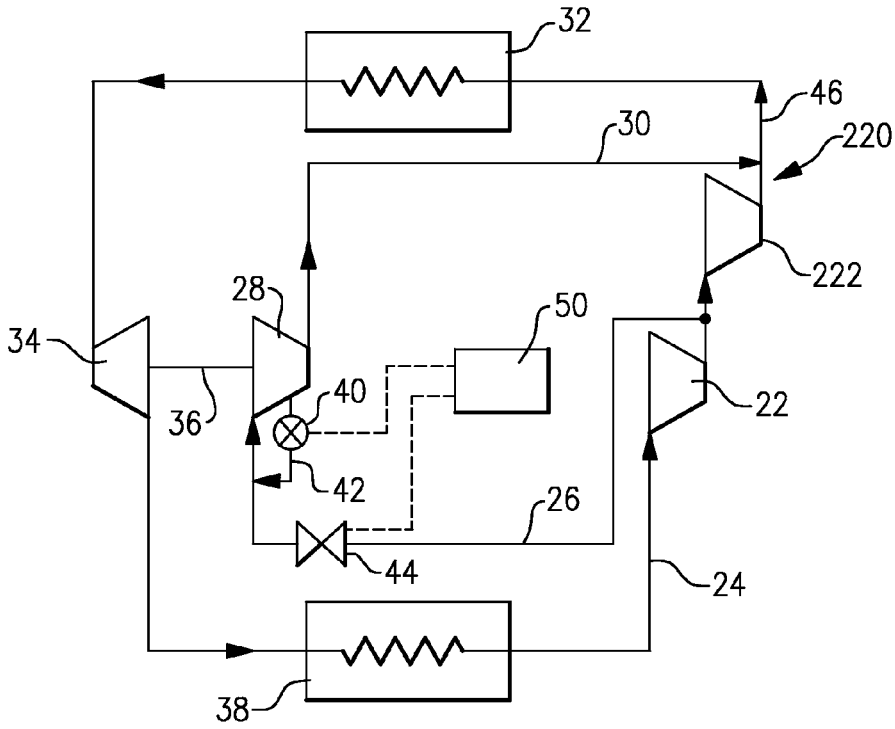
FIG. 3 is a view of another schematic.

Similarly, in the embodiment 220 shown in FIG. 3, the secondary compressor 28 may be positioned to operate in parallel (or in tandem) with the second compression stage 222 and to compress refrigerant from an intermediate pressure to a discharge pressure. Other arrangements are also possible, where for instance, the main and secondary compressor operating in tandem may compress refrigerant to a pressure lower then the pressure associated with the heat rejection heat exchanger 32. Further, if multiple intermediate pressure levels are available within the refrigerant cycle, the secondary compressor 28 may operate between its own pressure levels, and not exactly in tandem with any of the primary compressors. These arrangements would also be typical of compressors installed in series.

Figure 4:
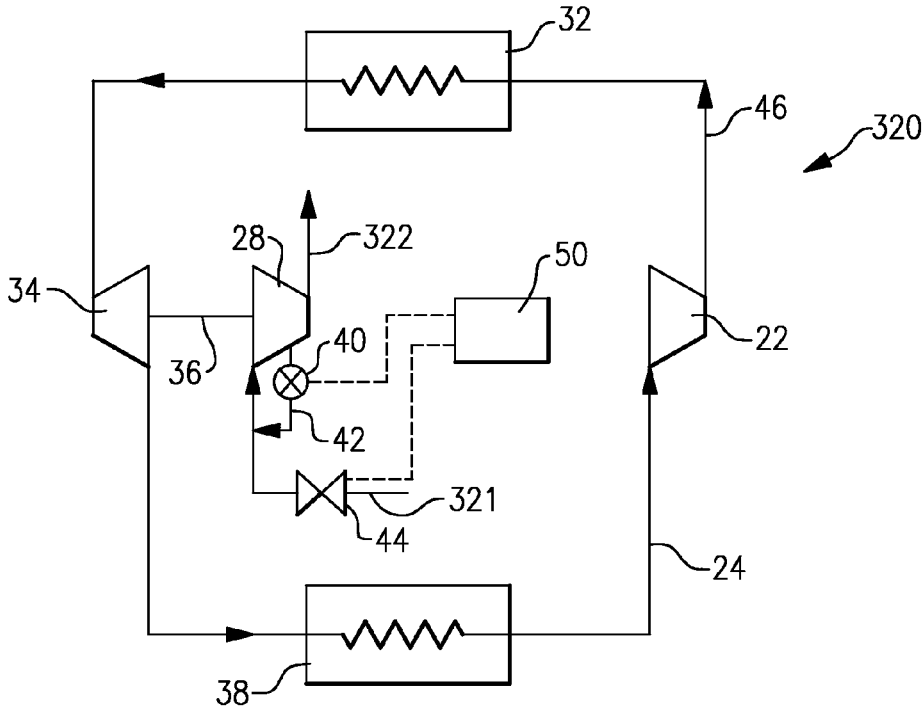
FIG. 4 is a view of another schematic.

Even further arrangements are possible, where, for example, the secondary compressor 28 is not compressing the refrigerant, but instead is compressing some other process fluid. In this case, in the embodiment 320 shown in FIG. 4, the secondary compressor may be used, for example, to compress air and deliver it from an inlet line 321 to an outlet line 322. As described above, a similar bypass arrangement may be used to control the amount of the bypassed air to shed off the compressor load to control the speed of the expander. Of course, in this case, since both the compressor 28 and the expander 34 are located on the same shaft, a special seal needs to be added onto the rotating shaft, as known, that would prevent the leakage of the refrigerant to the ambient environment.

Further, in all the embodiments above, a clutch can be installed on the rotating shaft 36 connecting the secondary compressor 28 and the expander 34 to selectively engage and disengage a mechanical coupling of these two expresser components.

It should be pointed out that many different compressor and expander types could be used in this invention. For example, scroll, screw, rotary, centrifugal or reciprocating compressors and expanders can be employed.

The refrigerant systems that utilize this invention can be used in many different applications, including, but not limited to, air conditioning systems, heat pump systems, marine container units, refrigeration truck-trailer units, and supermarket refrigeration systems.

Furthermore, it has to be understood that although this invention can be applied to any economized refrigerant systems, the refrigerant systems employing $CO_2$ as a refrigerant would particularly benefit from this invention, since these systems have inherit deficiencies and require additional means for the performance enhancement.

Although a preferred embodiment of this invention has been disclosed, a worker of ordinary skill in the art would recommend that certain modifications would come within the scope of this invention. For that reason, the following claims should be studied to determine the true scope and content of this invention.

We claim:

1. A refrigerant system comprising:

a main compressor to compress refrigerant and to circulate the refrigerant throughout said refrigerant system;

a secondary compressor, said secondary compressor at least partially driven by an expander, where at least a portion of the refrigerant circulating throughout said refrigerant system is expanded in said expander from a higher pressure to a lower pressure;

a control for determining desired characteristics of an expansion process, and said control being operable to control a load on the expander provided by said secondary compressor to achieve said desired characteristic of said expansion process;

said control determining whether an increase or a decrease of a speed of the expander is desired, and increasing the load on said secondary compressor if a decrease in the speed of said expander is desired, and decreasing the load on said secondary compressor when an increase in the speed of the expander is desired; and said secondary compressor compresses fluid other than the refrigerant circulating throughout said refrigerant system.

2. A method for operating a refrigerant system comprising the steps of:

(1) providing a main compressor to compress refrigerant and to circulate this refrigerant throughout said refrigerant system;

(2) providing a secondary compressor, said secondary compressor at least partially driven by an expander, where at least a portion of the refrigerant circulating throughout said refrigerant system is expanded in said expander from a higher pressure to a lower pressure;

(3) determining desired characteristics of the expansion process, and changing a load on the expander provided by said secondary compressor to achieve said desired characteristic of said expansion process;

(4) determining whether an increase or a decrease of a speed of the expander is desired, and increasing the load on said secondary compressor if a decrease in the speed of said expander is desired, and decreasing the load on said secondary compressor when an increase in the speed of the expander is desired; and (5) said secondary compressor compresses fluid other than the refrigerant circulating throughout said refrigerant system.

* * * * *